US006112534A

United States Patent [19]

Taras et al.

[11] Patent Number: 6,112,534

[45] Date of Patent: Sep. 5, 2000

[54] REFRIGERATION AND HEATING CYCLE SYSTEM AND METHOD

[75] Inventors: Michael F. Taras, Fayetteville; John R. Reason, Liverpool; Russell G. Lewis, Manlius, all of N.Y.

[73] Assignee: Carrier Corporation, Sryacuse, N.Y.

[21] Appl. No.: 09/127,213

[22] Filed: Jul. 31, 1998

[51] Int. Cl.[7] ..... F25B 41/04

[52] U.S. Cl. ..... 62/217; 62/140; 62/156; 62/228.1

[58] Field of Search ..... 62/217, 228.1, 62/140, 81, 277, 278, 156, 160, 511

[56] References Cited

U.S. PATENT DOCUMENTS

| | | | |
|---|---|---|---|
| 4,352,272 | 10/1982 | Taplay | 62/235.1 |
| 4,916,913 | 4/1990 | Narikiyo | 62/81 |
| 4,977,751 | 12/1990 | Hanson | 62/81 |
| 5,182,920 | 2/1993 | Matsuoka et al. | 62/206 |
| 5,201,185 | 4/1993 | Hanson et al. | 62/81 |
| 5,596,878 | 1/1997 | Hanson et al. | 62/160 |
| 5,907,957 | 6/1999 | Lee et al. | 62/217 |

*Primary Examiner*—Henry Bennett
*Assistant Examiner*—Marc Norman

[57] ABSTRACT

An Improved Refrigeration System and Heating/Defrost Cycle is disclosed. The system, for heating circulating air and defrosting an enclosed area, includes a refrigerant, an evaporator using said refrigerant for heating the circulating air; and a compressor for receiving the refrigerant from the evaporator and compressing the refrigerant to a higher temperature and pressure. Advantageously, the system further includes the combination of an expansion valve positioned between the compressor and the evaporator for forming a partially expanded refrigerant, a controller for sensing system parameters, and a mechanism responsive to said controller, based on the sensed parameters, for increasing temperature differential between the refrigerant and the circulating air, for improving system efficiency and for optimizing system capacity during heating and defrost cycles.

10 Claims, 1 Drawing Sheet

REFRIGERATION AND HEATING CYCLE SYSTEM AND METHOD

TECHNICAL FIELD

This invention is directed to heating/defrost cycles, and more particularly, to an improved heating cycle incorporating an electronically controlled suction-line-modulation valve (SMV) positioned between the evaporator and compressor for optimizing the capacity of the heating/defrost cycle in concert with the thermal expansion valve, for improving temperature differential in the evaporator between the refrigerant and circulating air, for improving fuel efficiency, for shortening the defrost cycle time, and for reducing the temperature variation inside the cooled compartment during switching between heating/defrost and cooling operating modes.

BACKGROUND ART

Refrigeration systems, such as those used in screw compression technology generally have extra cooling capacity during most operating modes, thereby leading to inefficient system operation. Based upon the specific mode in which the compressor system is operating, different refrigeration capacity controls provide for desired performance in the most efficient manner. Electronically controlled suction-line-modulation valve is one such means and is often included in system configurations. For the heating and defrost operations in a typical refrigeration system which includes a compressor, a condenser, a thermal expansion valve and an evaporator, the capacity control strategy doesn't have a lot of flexibility and therefore is not very efficient. In standard heating/defrost cycles, the temperature difference between the air being heated and refrigeration stream is very limited due to the fixed temperature of the air within the enclosure and limited compressor pumping capacity. Accordingly, improving the temperature differential in some manner can dramatically improve the heating or defrost cycle efficiency and improve overall system performance.

The prior art does include several manually adjustable preset valve designs for controlling system capacity or throttling the refrigerant stream between the evaporator and compressor. These valves include suction service valves and other manually adjustable valves, such as a compressor-crankcase-pressure regulating (CPR) valves. However, the drawback of these valves is that any capacity adjustments made therewith must be done manually, thereby requiring constant attention to the mode of the refrigeration cycle. These valves are almost impossible to control due to a variety of operating conditions and modes as well as transient system behavior. Accordingly, CPR valves are manually preset for a specific condition and operating mode, without changing state.

The prior art includes a plurality of refrigeration systems, some of which use valves positioned between the evaporator exit and the compressor inlet, on the suction line. Some of these valves are used to control system capacity but none are electronically controlled and programmable to control system heating/defrost capacity in conjunction with thermal expansion valve adjustments. For example, U.S. Pat. No. 4,977,751 discloses a valve system having a modulation valve which also performs the function of a compressor throttling valve. The valve is positioned between the evaporator outlet and compressor inlet, as represented in FIG. 2 by valve 54, evaporator 42 and compressor 14. The modulation valve 54 controls refrigerant flow to compressor 14. A load circuit operates valve 54 to perform the function of a throttling valve when load reduction is required in the cooling mode. An overload condition of a compressor prime mover overrides a control and selects a predetermined load control position of the valve on overload. The timer switches back to the control when a predetermined recovery time has past. In heating and defrost, the system automatically selects the load control position of the valve 54 for the duration of the mode, as does the ambient air temperature sensor when the ambient precedes a predetermined value. While the modulation valve 54 is controllable during the valve cycle, during defrost and heating, the valve is only controllable to a preset position or opening size. Variations in the cycles in accordance with thermal expansion valve activity cannot be accounted for to achieve optimum system capacity. Accordingly, while controllable, the valve 54 of this system lacks flexibility otherwise desirable in the defrost and heating modes, and in conjunction with the thermal expansion valve.

Additional patents drawn to systems used to vary system capacity during cooling are shown in U.S. Pat. No. 4,689,967 to Han et al, and for U.S. Pat. No. 4,712,383 to Howland et al, and U.S. Pat. No. 4,742,689 to Lowes. None of the systems disclosed in these patents exhibit the controllability of the defrost and heating modes and the hot-gas valve, which is desired to have the complete degree of capacity control and reach optimum system heating/defrosting capability.

There exists a need, therefore, for a refrigeration air conditioning cycle having an electronically controlled Suction Modulation Valve (SMV) which is operable to control system capacity in the heating and defrost modes.

DISCLOSURE OF INVENTION

The primary object of this invention is to provide an improved refrigeration system, particularly for transport refrigeration configurations, having an improved mechanism for controlling system performance during the heating and defrost system modes and optimizing temperature differential at the evaporator between the refrigerant and circulating air.

Another object of this invention is to provide a refrigeration air-conditioning system including a evaporator, compressor, condenser and thermal expansion valve, having an electronically controlled and programmable suction-line-modulation-valve SMV for controlling system capacity and temperature differential in the defrost and heating modes.

And yet another object of this invention is to provide a transport refrigeration system having an electronically controllable and programmable SMV positioned between the evaporator and compressor on the suction line, wherein the valve is operable to control system capacity by adjusting its orifice in response to electronic commands and achieve optimal temperature differential in the evaporator between the refrigerant and circulating air.

Another object of this invention is to provide an improved heating/defrost method, particularly for transport refrigeration configurations, having an improved process for controlling system performance during the heating and defrost system modes and optimizing temperature differential at the evaporator between the refrigerant and circulating air.

The foregoing objects and following advantages are achieved by the Improved Refrigeration System and Heating/Defrost Cycle of the present invention. The system, for heating circulating air and defrosting an enclosed area, includes a refrigerant, an evaporator using said refrigerant for heating the circulating air; and a compressor for receiving the refrigerant from the evaporator and compressing the refrigerant to a higher temperature and pressure. Advantageously, the system further includes the combination of an expansion valve positioned between the compressor and the evaporator for forming a partially expanded refrigerant, a controller for sensing system parameters, and a mechanism responsive to said controller, based on the sensed parameters, for increasing temperature differential between the refrigerant and the circulating air, for improving system efficiency and for optimizing system capacity during heating and defrost cycles.

DETAILED DESCRIPTION OF THE PREFERRED EMBODIMENT

Figure 1:
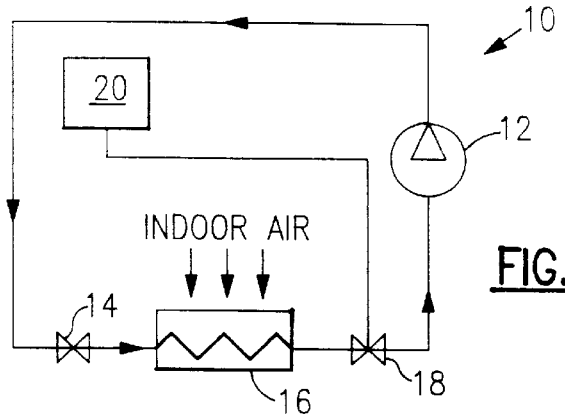
FIG. 1 is a schematic view of a refrigeration heating/defrost cycle, including a programmable suction modulation valve (SMV) in accordance with the principles of the present invention.

Referring now to the drawings in detail, there is shown in FIG. 1 a heating/defrost cycle, in accordance with the principles of the present invention, designated generally as 10. The system generally includes a compressor 12, a hot-gas valve 14, an evaporator 16, and an electronically controllable suction modulation valve 18. The overall purpose of this invention is to provide a system which improves heat transfer at the evaporator during a heating/defrost cycle due to an increased AT. Accordingly, the SMV 18 is operable via electronic control to cause an increase in heat flux at the evaporator by controlling pressure in the evaporator to an optimal value.

Figure 2:
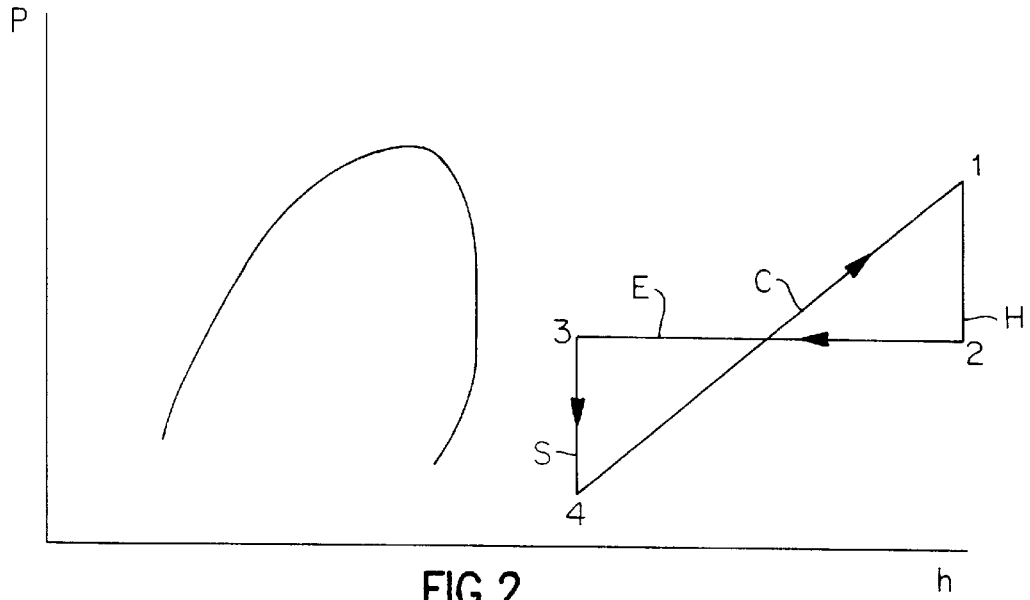
FIG. 2 is a pressure-enthalpy diagram indicative of the heating cycle improvements achieved by the system of the present invention.
Figure 3:
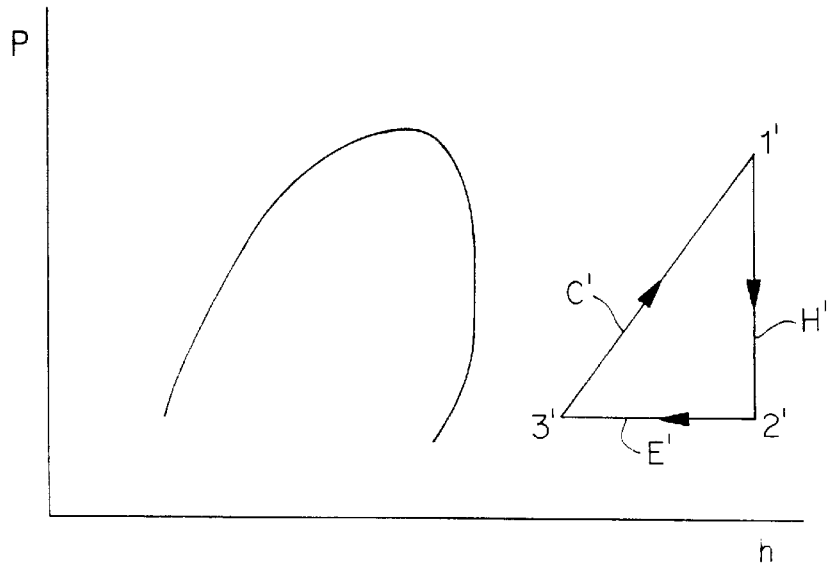
FIG. 3 is a pressure-enthalpy diagram indicative of a typical prior art heating cycle.

Valve 18 used in the method/system of the present invention is a readily available electronically programmable valve and is placed in refrigeration system 10, on the suction line, between the evaporator and the compressor. By throttling the refrigerant stream and regulating evaporator pressure, the temperature of the refrigerant while in the evaporator can be controlled, and preferably increased, to improve temperature differential relative to circulating air and improve evaporator heat flux. Referring now to FIG. 2, a pressure-enthalpy diagram is shown, which is representative of the heating/defrost cycle of the present invention, having a large ΔT. In this diagram, C represents the compression process, H represents the hot-gas valve expansion process, E represents the heat transfer in the evaporator, and S represents throttling through the SMV, and the corresponding pressure and temperature changes.

Beginning at point 1, refrigerant enters the hot gas valve 14, which for the heating/defrost mode is always in the open position, under high pressure from compressor 12, and in compliance with the control system of the invention, is partially expanded to an intermediate pressure at point 2 where the refrigerant is caused to enter the evaporator 16. At point 2, the refrigerant is at an intermediate temperature and pressure. From point 2 to point 3, heat is released from the refrigerant in the evaporator to the compartment air based on a greater temperature differential, thereby achieving greater heat flux. In a typical cycle, without an SMV, as indicated by the like symbols C', H', and E', and 1', 2', and 3', at point 3', the compression stroke would occur. However, in the heating/defrost cycle of the present invention, the SMV 18 is operable to further expand the refrigerant to suction pressure prior to entrance into the compressor, from points 3 to 4. The optimal value for suction line restriction by the SMV and associated degree of refrigerant expansion is determined by system parameters sensed by the controller. These parameters include ambient and enclosure temperature, as well as the operating mode or capacity of the compressor, being, for example loaded or unloaded. The optimal values are not given as they are dependent on the specific system being used. However, the optimal values are readily determinable by one skilled in the art wishing to obtain, for a particular system, an optimal temperature differential between the refrigerant and enclosure air in a heating/defrost cycle. The combined usage of hot gas valve expansion and SMV expansion along with the associated pressure drops, allows the compressor to operate at substantially the same suction and discharge refrigerant state points, points 1 and 4 of FIG. 2, all the time, causing the refrigerant to consistently achieve a higher temperature while entering the evaporator. Accordingly, ΔT is increased relative to the cargo air temperature, causing an increase in the temperature of the enclosure air at faster rate. This shortens cycle time, improves fuel efficiency and optimizes system performance. Since the SMV 18 is programmable, the degree of throttling and accordingly expansion, is automatically adjusted based on the cargo and ambient air temperatures, operating regime and the amount of partial expansion through the hot gas valve 14, as monitored by a control system 20.

The primary advantage of this invention is that an improved refrigeration system is provided for transport refrigeration configurations, having an improved mechanism for controlling system capacity during the heating and defrost system modes.

Another advantage of this invention is that an air-conditioning system is provided including a evaporator, compressor, condenser and thermal expansion valve, having an electronically controlled and programmable suction-line-modulation valve (SMV) for controlling system capacity in the defrost and heating modes. And yet another advantage of this invention is that a transport refrigeration system is provided having an electronically controllable and programmable SMV positioned between the evaporator outlet and compressor inlet, wherein the valve is operable to control system capacity by adjusting its orifice in response to electronic commands. Another advantage of this invention is that an improved heating/defrost method is provided, particularly for transport refrigeration configurations, having an improved process for controlling system performance during the heating and defrost system modes and optimizing temperature differential at the evaporator between the refrigerant and circulating air.

Although the invention has been shown and described with respect to the best mode embodiment thereof, it should be understood by those skilled in the art from the foregoing that various other changes, omissions, and additions in the form and detail thereof may be made without departing from the spirit and scope of the invention.

What is claimed is:

1. A refrigeration/air conditioning system for heating circulating air and defrosting an enclosed area, comprising:

a refrigerant;

an evaporator for using said refrigerant for heating the circulating air;

a compressor for receiving said refrigerant from said evaporator and compressing said refrigerant to a higher temperature and pressure;

an expansion valve positioned between said compressor and said evaporator for forming a partially expanded refrigerant;

means for sensing and processing a plurality of system parameters; and means responsive to said means for sensing and processing based on values of said system parameters for increasing temperature differential between said refrigerant and the circulating air, for improving system efficiency and for optimizing system capacity during heating and defrost cycles.

2. The system according to claim 1, wherein said means for increasing includes means for elevating evaporator refrigerant pressure and temperature in accordance with the required system capacity as required by the particular heating and defrost cycles.

3. The system according to claim 1, wherein said refrigerant flows between said evaporator and said compressor through a suction line, said means for increasing comprising an electronically controllable suction line modulation valve located on said suction line.

4. The system according to claim 3, wherein said suction line modulation valve includes means for restricting suction line volumetric refrigerant flow.

5. The system according to claim 4, wherein said means for sensing comprises an electronic controller in communication with said means for restricting said suction line modulation valve, said system parameters including enclosed area temperature, ambient temperature, and system capacity, wherein based on the value of said system parameters, said means for restricting is adjusted for adjusting the temperature and pressure of said refrigerant prior to entering said compressor such that a substantially optimal differential between said refrigerant and the circulating air is achieved.

6. A refrigeration/air conditioning method for heating circulating air and defrosting an enclosed area, comprising:

compressing a refrigerant to a higher temperature and pressure;

expanding said refrigerant for forming a partially expanded refrigerant;

transferring heat from said refrigerant to air circulating in the enclosure for heating the air;

sensing and processing a plurality of system parameters; and increasing temperature differential between said refrigerant and the circulating air in response to said step of sensing and processing based on values of said system parameters for improving system efficiency and for optimizing system capacity during heating and defrost cycles.

7. The method according to claim 6, wherein said step of increasing includes elevating evaporator refrigerant pressure and temperature in accordance with the required system capacity as required by the particular heating and defrost cycles.

8. The method according to 6, wherein said step of increasing is performed by an electronically controllable suction line modulation valve located on said suction line, further comprising the step of said suction line modulation valve restricting suction line volumetric refrigerant flow.

9. The method according to claim 8, wherein said step of sensing and processing comprises an electronic controller sensing system parameters including enclosed area temperature, ambient temperature, and system capacity, and based on the value of said system parameters, said electronic controller implementing said step of restricting for adjusting the temperature and pressure of said refrigerant prior to entering said compressor such that a substantially optimal temperature differential between said refrigerant and the circulating air is achieved.

10. The system according to claim 1, wherein said means for sensing and processing operates continuously during heating and defrosting modes.

* * * * *